US009057318B2

(12) United States Patent
Kim

(10) Patent No.: US 9,057,318 B2
(45) Date of Patent: Jun. 16, 2015

(54) RADIATOR FOR VEHICLE

(75) Inventor: Jae Yeon Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 303 days.

(21) Appl. No.: 13/532,336

(22) Filed: Jun. 25, 2012

(65) Prior Publication Data

US 2013/0146261 A1 Jun. 13, 2013

(30) Foreign Application Priority Data

Dec. 7, 2011 (KR) ..... 10-2011-0130552

(51) Int. Cl.
*F01P 11/00* (2006.01)
*F01P 11/02* (2006.01)
*F01P 3/18* (2006.01)

(52) U.S. Cl.
CPC . *F01P 11/028* (2013.01); *F01P 3/18* (2013.01)

(58) Field of Classification Search
CPC ..... F01P 11/028; F01P 19/0057
USPC ..... 165/104.32; 96/206, 21, 261
See application file for complete search history.

(56) References Cited

U.S. PATENT DOCUMENTS 2,200,620 A * 5/1940 Findley ..... 237/12.3 B
2,231,501 A * 2/1941 Jepertinger ..... 237/12.3 B
3,028,716 A * 4/1962 Sanderson et al. ..... 96/208
3,800,946 A * 4/1974 Reid et al. ..... 210/788
4,075,984 A * 2/1978 Kirchgessner et al. .... 123/41.54
4,199,332 A * 4/1980 Krohn et al. ..... 96/208
4,201,555 A * 5/1980 Tkach ..... 95/15
4,247,309 A * 1/1981 Buddenhagen ..... 95/261
4,548,622 A * 10/1985 Suzuki et al. ..... 96/209
4,776,390 A * 10/1988 Crofts ..... 165/104.32
5,257,661 A * 11/1993 Frech et al. ..... 165/104.32
6,517,732 B1 * 2/2003 Brockoff et al. ..... 210/782
7,878,231 B2 * 2/2011 Akiyama et al. ..... 165/41

FOREIGN PATENT DOCUMENTS

JP 05-090179 U 12/1993
JP 11-014283 A 1/1999
JP 2007-253691 A 10/2007
JP 2010-084589 A 4/2010
KR 20-1999-0003208 U 1/1999
KR 10-0534895 A 12/2005

* cited by examiner

*Primary Examiner* — Allen Flanigan
(74) *Attorney, Agent, or Firm* — Morgan, Lewis & Bockius LLP

(57) ABSTRACT

A radiator for a vehicle may include an inlet tank adapted to receive coolant from an engine; an outlet tank disposed apart from the inlet tank and adapted to discharge the coolant back to the engine; a heat-exchanging portion fluidly connecting the inlet tank and the outlet tank and provided with a plurality of tubes and radiation fins to cool the coolant flowing in the tubes by exchanging heat with air; and a bubble separating unit connected to the inlet tank and adapted to separate bubble contained in the coolant discharged from the engine and to continuously discharge the coolant from which the bubble is separated to a reserve tank to supply the coolant from which the bubble is separated to the heat-exchanging portion.

11 Claims, 7 Drawing Sheets

RADIATOR FOR VEHICLE

CROSS-REFERENCE TO RELATED APPLICATION

The present application claims priority of Korean Patent Application Number 10-2011-0130552 filed Dec. 7, 2011, the entire contents of which application is incorporated herein for all purposes by this reference.

BACKGROUND OF INVENTION

1. Field of Invention

The present invention relates to a radiator for a vehicle. More particularly, the present invention relates to a radiator for a vehicle that improves cooling efficiency of coolant by receiving the coolant therein after bubble contained in the coolant exhausted from an engine is separated from the coolant.

2. Description of Related Art

Generally, mixture of fuel and air is injected into a cylinder of an engine and explosive force produced when the mixture is burnt is delivered to a driving wheel in a vehicle. Thereby, the vehicle runs. The engine is provided with a cooling apparatus such as a water jacket for cooling the engine of high temperature due to combustion of the mixture, and coolant, a temperature of which is raised when circulating through the water jacket is cooled by a radiator.

The radiator is divided into an air cooled radiator and a water cooled radiator according to cooling type, and is divided into a cross-flow radiator and a down-flow radiator according to flow direction of the coolant.

The air cooled radiator is a radiator in which the coolant is cooled by air and is universally used for a small engine. The water cooled radiator is a radiator in which the coolant is cooled by additional coolant and is used for a big engine.

The cross-flow radiator and the down-flow radiator are determined according to the flow direction of the coolant.

According to a conventional radiator, an inlet tank into which the coolant flows and an outlet tank from which the coolant is exhausted are disposed apart from each other, and a plurality of tubes is mounted between the inlet tank and the outlet tank so as to fluidly connect the inlet tank and the outlet tank. The coolant flows in the plurality of tubes and is cooled by exchanging heat with air.

Herein, the cross-flow radiator is a radiator where the inlet tank and the outlet tank are disposed at the left and the right and the tubes are mounted horizontally. Therefore, the coolant flows horizontally and is cooled in the cross-flow radiator.

In addition, the down-flow radiator is a radiator where the inlet tank and the outlet tank are disposed at the upside and the downside and the tubes are mounted vertically. Therefore, the coolant flows vertically and is cooled in the down-flow radiator.

The radiator is disposed in an engine compartment of the vehicle facing toward the front such that the coolant exchanges heat with cool air when the vehicle runs.

In a case that bubble is contained in the coolant exhausted after cooling the engine, however, the coolant including the bubble having lower coefficient of heat transfer flows according to a conventional radiator. The bubble takes a predetermined volume in a circulating line of the coolant and deteriorates heat exchanging performance. Therefore, cooling efficiency of the radiator may be deteriorated.

In a case that cooling efficiency of the radiator is deteriorated, the coolant is supplied to the engine in a state of not being cooled to a demand temperature. Therefore, the engine may not be cooled preferably and cooling performance of the vehicle may be deteriorated.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a radiator for a vehicle having advantages of preventing increase of flow resistance of coolant passing through a heat-exchanging portion by bubble contained in the coolant and improving cooling efficiency by separating the bubble from the coolant supplied from an engine and supplying the bubble to a reserve tank continuously.

Various aspects of the present invention provide for a radiator for a vehicle having further advantages of improving cooling performance of the engine without increasing capacity of the radiator, reducing a size of the radiator, lowering manufacturing cost, and improving utilization of space in an engine compartment by improving cooling efficiency of the coolant so as to cool the coolant to a demand temperature.

Various aspects of the present invention provide for a radiator for a vehicle that may include an inlet tank adapted to receive coolant from an engine; an outlet tank disposed apart from the inlet tank and adapted to discharge the coolant back to the engine; a heat-exchanging portion fluidly connecting the inlet tank and the outlet tank and provided with a plurality of tubes and radiation fins so as to cool the coolant flowing in the tubes by exchanging heat with air; and a bubble separating unit connected to the inlet tank and adapted to separate bubble contained in the coolant discharged from the engine and to continuously discharge the coolant from which the bubble is separated to a reserve tank so as to supply the coolant from which the bubble is separated to the heat-exchanging portion.

The bubble separating unit may include a main body provided with an inflow port formed at a side surface thereof and connected to the engine through a connecting hose and an exhaust port formed at another side surface thereof and connected to an inlet formed at the inlet tank; a bubble generating portion formed at an interior circumference of the inflow port and adapted to cause the coolant to rotate and generate a whirlpool so as to separate the bubble from the coolant when the coolant flows into the inflow port; and a bubble exhaust port formed at a side surface of an upper portion of the main body and connected to the reserve tank so as to exhaust the bubble separated from the coolant at the bubble generating portion to the reserve tank.

The bubble generating portion may be a spiral groove formed at an interior circumference of the inflow port with a spiral shape.

A mounting position of the inflow port may be higher than that of the exhaust port.

The exhaust port may be formed at another side surface neighboring the side surface where the inflow port is formed.

The radiator may further include a coolant supplement port integrally formed at an upper portion of the inlet tank, wherein the coolant is supplemented from the reserve tank through the coolant supplement port.

The bubble separating unit may include an inflow port integrally formed at a side of an upper portion of the inlet tank and connected to the engine through a connecting hose so as to receive the coolant from the engine; a bubble generating portion formed at the inflow port and adapted to cause the coolant to rotate and generate a whirlpool so as to separate the bubble from the coolant when the coolant flows into the inflow port; an extended portion protruded from an upper end of the inlet tank; and a bubble exhaust port formed at a side of an upper portion of the extended portion and connected to the reserve tank so as to exhaust the bubble separated from the coolant at the bubble generating portion to the reserve tank.

The bubble generating portion may be a spiral groove formed at an interior circumference of the inflow port with a spiral shape.

The bubble generating portion may include an inserting body inserted in the inflow port and fixed to an interior circumference of the inflow port; and a spiral groove formed at an interior circumference of the inserting body along a length direction.

The reserve tank may be connected to the engine.

An internal pressure of the reserve tank may be maintained to be the same as that of the engine.

The radiator may further include a coolant supplement port disposed apart from the bubble exhaust port, formed at a side of a lower portion of the extended portion, and connected to the reserve tank so as to supplement the coolant.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
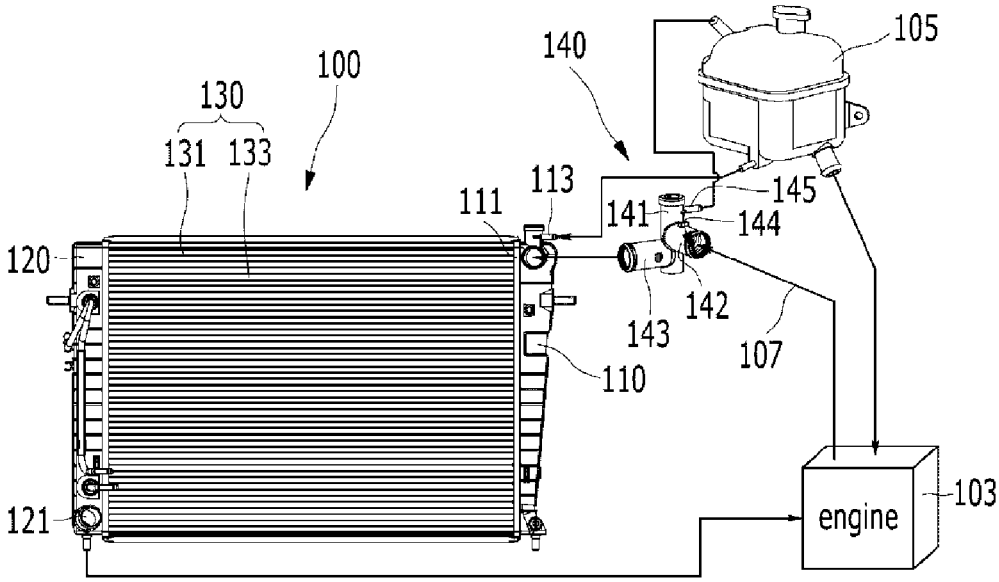
FIG. 1 is a schematic diagram of an exemplary radiator for a vehicle according to the present invention.
Figure 2:
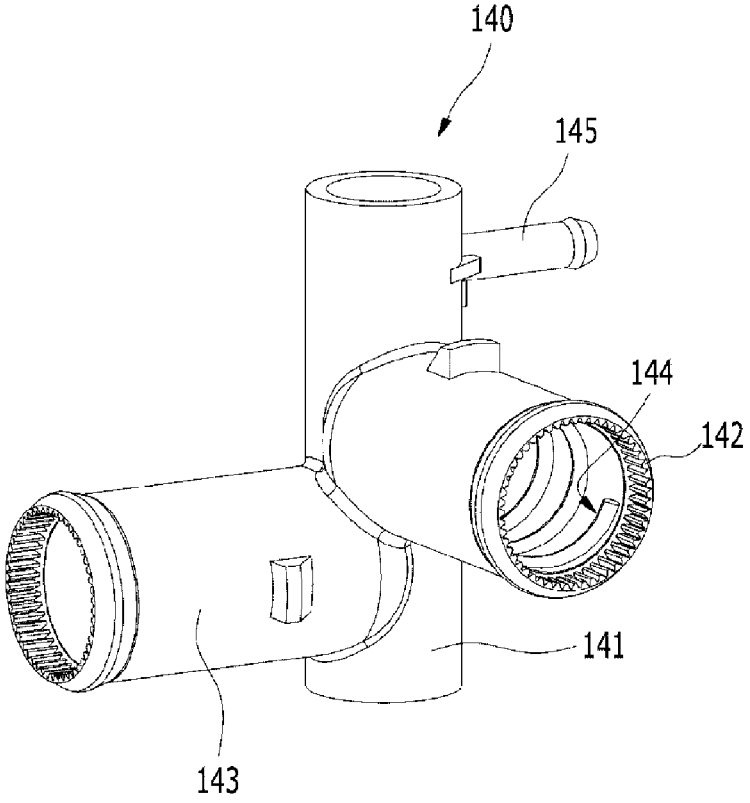
FIG. 2 is a perspective view of an exemplary bubble separating unit applied to a radiator for a vehicle according to the present invention.

FIG. 1 is a schematic diagram of a radiator for a vehicle according to various embodiments of the present invention, and FIG. 2 is a perspective view of a bubble separating unit applied to a radiator for a vehicle according to various embodiments of the present invention.

Referring to the drawings, a radiator 100 for a vehicle according to various embodiments of the present invention is adapted to prevent increase of flow resistance of coolant passing through a heat-exchanging portion 130 by bubble contained in the coolant and to improve cooling efficiency by separating the bubble from the coolant supplied from an engine 103 and by supplying the bubble to a reserve tank 105 continuously.

For these purpose, the radiator 100 for the vehicle according to various embodiments of the present invention, as shown in FIG. 1, includes an inlet tank 110, an outlet tank 120 and a heat-exchanging portion 130.

The inlet tank 110 into which the coolant flows is disposed apart from the outlet tank 120 from which the coolant is exhausted.

In addition, the heat-exchanging portion 130 is disposed between the inlet tank 110 and the outlet tank 120. The heat-exchanging portion 130 connects inner sides of the inlet tank 110 and the outlet tank 120.

The heat-exchanging portion 130 includes a plurality of tubes 131 and radiation fins 133, and the coolant flowing through the tubes 131 exchanges heat with air.

The radiator 100 for the vehicle according to various embodiments of the present invention further includes a bubble separating unit 140 connected to the inlet tank 110. The bubble separating unit 140 is adapted to separate bubble contained in the coolant discharged from the engine 103 and to continuously discharge the coolant from which the bubble is separated to a reserve tank 105 so as to supply the coolant from which the bubble is separated to the heat-exchanging portion 130.

Meanwhile, the reserve tank 105 is connected to the engine 103, and an internal pressure of the reserve tank 105 is maintained to be the same as that of the engine 103.

According to various embodiments, the bubble separating unit 140, as shown in FIG. 2, includes a main body 141, a bubble generating portion 144, and a bubble exhaust port 145, and each constituent element will be described in detail.

An upper end and a lower end of the main body 141 are closed. An inflow port 142 connected to the engine 103 through a connecting hose 107 is formed at a side surface of the main body 141, and an exhaust port 143 connected to an inlet 111 formed at the inlet tank 110 is formed at another side surface of the main body 141.

A mounting position of the inflow port 142 is higher than that of the exhaust port 143.

In addition, the exhaust port 143 is formed at another side surface neighboring the side surface where the inflow port 142 is formed.

The main body 141 has a cylindrical shape, and the upper and lower ends of the main body 141 may be closed.

In addition, the bubble generating portion 144 is formed at an interior circumference of the inflow port 142. When the coolant flows into the inflow port 142, the bubble generating portion 144 causes the coolant to rotate and generate a whirlpool so as to separate the bubble from the coolant.

The bubble generating portion 144 may be a spiral groove formed at an interior circumference of the inflow port 142 with a spiral shape.

That is, the coolant flows along the spiral groove formed with the spiral shape and is rotated when the coolant flows in the bubble generating portion 144.

If the coolant rotates along the interior circumference of the bubble generating portion 144, the whirlpool is generated at a center portion of the bubble generating portion 144 in a length direction by centrifugal force. At this time, the bubble is gathered to a center of the whirlpool and is separated from the coolant.

The coolant from which the bubble is separated passes through the inflow port 142 and then flows into the main body 141 where the bubble generating portion 144 is not formed. At this time, centrifugal force becomes weak and rotation of the coolant is stopped.

According to various embodiments, the bubble exhaust port 145 is formed at a side surface of the main body 141 above the inflow port 142. The bubble exhaust port 145 is connected to the reserve tank 105 and the bubble separated from the coolant at the bubble generating portion 144 is exhausted to the reserve tank 105 through the bubble exhaust port 145.

That is, centrifugal force of the coolant from which the bubble is separated becomes weak in the main body 141, and the coolant is exhausted through the exhaust port 143 formed below the inflow port 142. In addition, since the bubble separated from the coolant is lighter than the coolant, the bubbles moves upward in the main body 141 and is exhausted to the reserve tank 105 through the bubble exhaust port 145.

At this time, since the internal pressure of the reserve tank 105 is the same as that of the engine 103, pressure of the bubble separated from the coolant is higher than the internal pressure of the reserve tank 105.

Therefore, the separated bubble in the main body 141 is exhausted to a space formed at an upper portion of the reserve tank 105 through the bubble exhaust port 145 continuously.

According to various embodiments, a coolant supplement port 113 for supplementing the coolant from the reserve tank 105 is integrally and/or monolithically formed at an upper portion of the inlet tank 110. The coolant supplement port 113 is connected to a lower portion of the reserve tank 105.

If there is lack of the coolant in the inlet tank 110, the coolant discharged from the reserve tank 105 is flowed into the inlet tank 110 through the coolant supplement port 113 so as to supplement the coolant to the inlet tank 110.

Hereinafter, operation of the radiator 100 for the vehicle according to various embodiments of the present invention will be described in detail.

Figure 3:
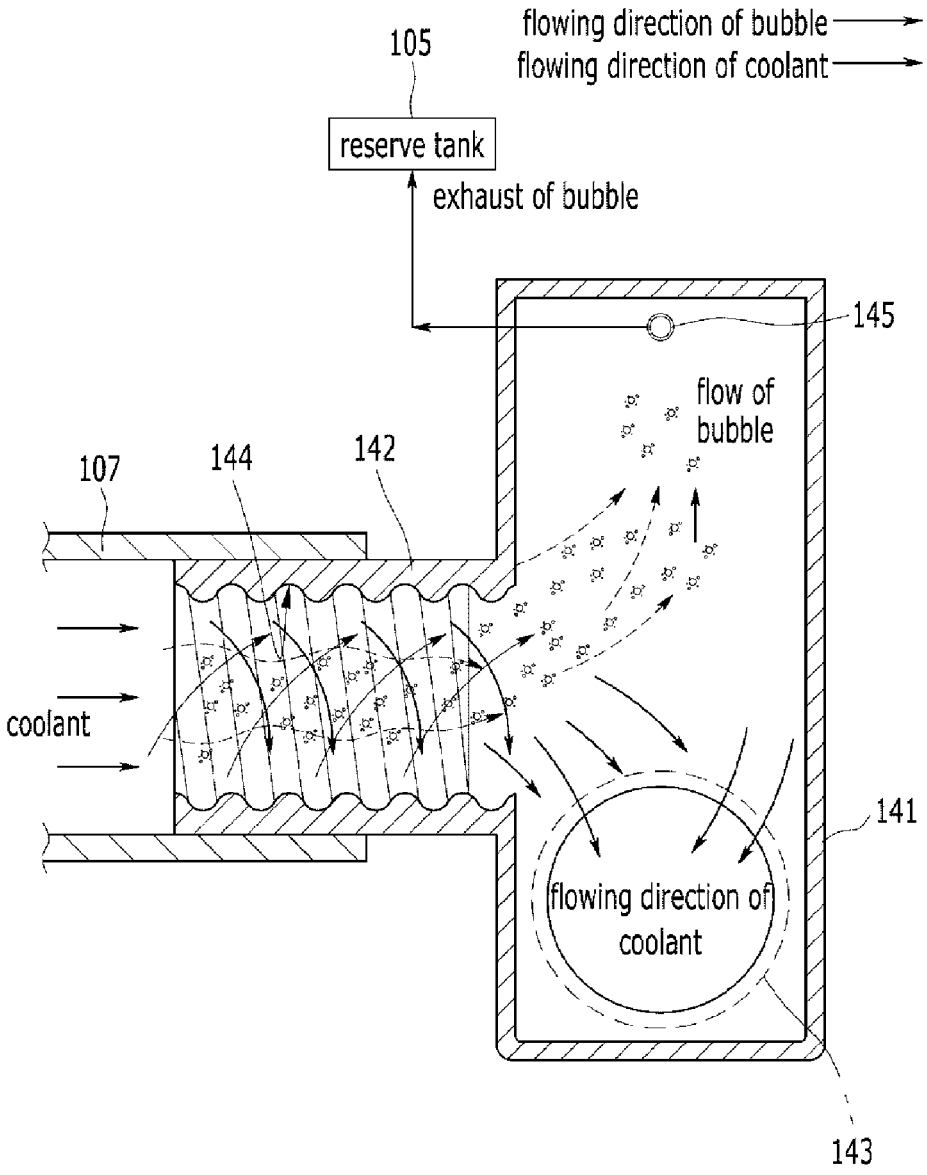
FIG. 3 is a cross-sectional view for showing operation of an exemplary radiator for a vehicle according to the present invention.

FIG. 3 is a cross-sectional view for showing operation of a radiator for a vehicle according to various embodiments of the present invention.

Referring to the drawing, the coolant cooling the engine 103 flows into the inflow port 142 of the main body 141 through the connecting hose 107.

The coolant is rotated by the bubble generating portion 144 of spiral groove shape formed at the inflow port 142 and flows into the main body 141.

When the coolant is rotated along the interior circumference of the bubble generating portion 144, the whirlpool is generated at the center potion of the bubble generating portion 144 in the length direction by centrifugal force. At this time, the bubble moves to the center of the whirlpool and is separated from the coolant.

If the coolant passes through the inflow port 142 and flows into the main body 141, centrifugal force becomes weak and rotation of the coolant is stopped. After that, the coolant flows into the inlet tank 110 through the exhaust port 143.

In addition, since the bubble separated from the coolant is lighter than the coolant, the bubble moves to the upper portion of the main body 141 and is exhausted to the reserve tank 105 through the bubble exhaust port 145.

At this time, since the pressure of the separated bubble is higher than the internal pressure of the reserve tank 105, the separated bubble can be discharged to the reserve tank 105 continuously.

In addition, the coolant flowing into the inlet tank 110 through the inlet 111 of the inlet tank 110 passes through the heat-exchanging portion 130 and is cooled through heat-exchange with air. After that, the coolant is supplied again to the engine through an outlet 121 formed at the outlet tank 120. Therefore, the coolant cools the engine 103.

The radiator 100 for the vehicle according to various embodiments of the present invention is adapted to prevent increase of flow resistance of coolant passing through a heat-exchanging portion 130 by bubble contained in the coolant and to improve cooling efficiency by separating the bubble from the coolant supplied from an engine 103 and by supplying the bubble to a reserve tank 105 continuously.

In addition, the radiator 100 for the vehicle according to various embodiments of the present invention is adapted to improve cooling performance of the engine 103 without increasing capacity of the radiator 100, to reduce a size of the radiator 100, to lower manufacturing cost, and to improve utilization of space in an engine compartment by improving cooling efficiency of the coolant and cooling the coolant to a demand temperature.

In addition, since the coolant from which the bubble is separated is flowed into the radiator 100 according to various embodiments, air inflow in the radiator 100 may be reduced and coefficient of heat transfer may be lowered.

Figure 4:
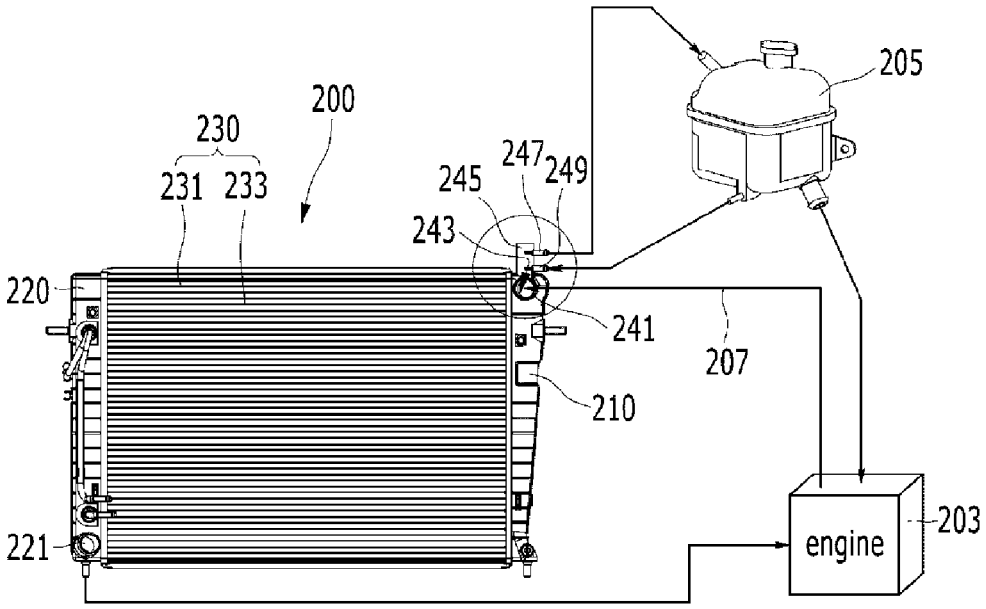
FIG. 4 is a schematic diagram of an exemplary radiator for a vehicle according to the present invention.
Figure 5:
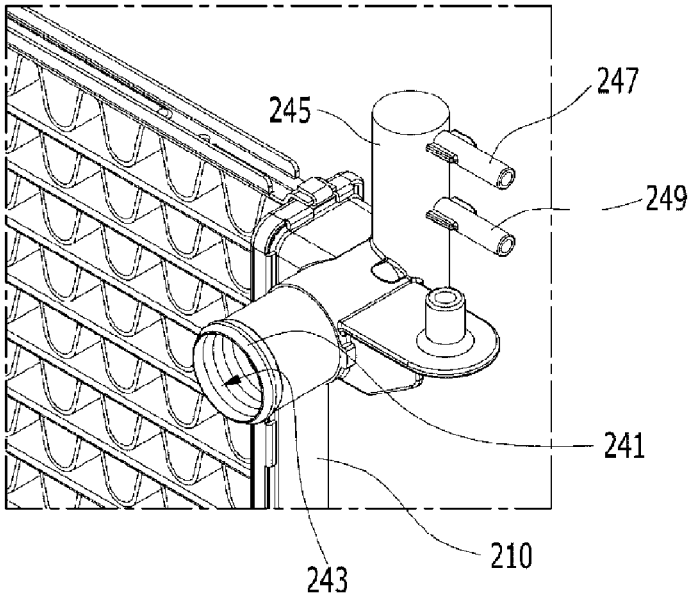
FIG. 5 is a partial enlarged perspective view of FIG. 4.

FIG. 4 is a schematic diagram of a radiator for a vehicle according to various embodiments of the present invention, and FIG. 5 is a partial enlarged perspective view of FIG. 4.

Referring to the drawings, a radiator 200 for a vehicle according to various embodiments of the present invention is adapted to prevent increase of flow resistance of coolant passing through a heat-exchanging portion 230 by bubble contained in the coolant and to improve cooling efficiency by separating the bubble from the coolant supplied from an engine 203 and by supplying the bubble to a reserve tank 205 continuously.

For these purposes, the radiator 200 for the vehicle according to various embodiments of the present invention, as shown in FIG. 4, includes an inlet tank 210, an outlet tank 220 and a heat-exchanging portion 230.

The inlet tank 210 into which the coolant flows is disposed apart from the outlet tank 220 from which the coolant is exhausted.

In addition, the heat-exchanging portion 230 is disposed between the inlet tank 210 and the outlet tank 220. The heat-exchanging portion 230 connects inner sides of the inlet tank 210 and the outlet tank 220.

The heat-exchanging portion 230 includes a plurality of tubes 231 and radiation fins 233, and the coolant flowing through the tubes 231 exchanges heat with air.

The radiator 200 for the vehicle according to various embodiments of the present invention further includes a bubble separating unit 240 connected to the inlet tank 210. The bubble separating unit 240 is adapted to separate bubble contained in the coolant discharged from the engine 203 and to continuously discharge the coolant from which the bubble is separated to a reserve tank 205 so as to supply the coolant from which the bubble is separated to the heat-exchanging portion 230.

Meanwhile, the reserve tank 205 is connected to the engine 203, and an internal pressure of the reserve tank 205 is maintained to be the same as that of the engine 203.

According to various embodiments, the bubble separating unit 240, as shown in FIG. 5, includes an inflow port 241, a bubble generating portion 243, an extended portion 245, a bubble exhaust port 247 and a coolant supplement port 249, and each constituent element will be described in detail.

The inflow port 241 is integrally and/or monolithically formed at a side of an upper portion of the inlet tank 210, and is connected to the engine 203 through the connecting hose 207 so as to flow the coolant discharged from the engine 203 into the inlet tank 210.

According to various embodiments, the bubble generating portion 243 is formed at the inflow port 241. When the coolant flows into the inflow port 241, the bubble generating portion 243 causes the coolant to rotate and generate a whirlpool so as to separate the bubble from the coolant.

The bubble generating portion 243 may be a spiral groove formed at an interior circumference of the inflow port 121 with a spiral shape.

That is, the coolant flows along the spiral groove formed with the spiral shape and is rotated when the coolant flows in the bubble generating portion 243.

If the coolant rotates along the interior circumference of the bubble generating portion 243, the whirlpool is generated at a center portion of the bubble generating portion 243 in a length direction by centrifugal force. At this time, the bubble is gathered to a center of the whirlpool and is separated from the coolant.

The coolant from which the bubble is separated passes through the inflow port 241 and then flows into the inlet tank 210. At this time, centrifugal force becomes weak in the inlet tank 210 having a larger cross-sectional area than the inflow port 241 does and rotation of the coolant is stopped.

According to various embodiments, the extended portion 245 is protruded from an upper end of the inlet tank 210 and an upper end of the extended portion 245 is closed.

In addition, the bubble exhaust port 247 is formed at a side of an upper portion of the extended portion 245, and is connected to the reserve tank 205 so as to exhaust the bubble separated from the coolant at the bubble generating portion 243 to the reserve tank 205.

The coolant from which the bubble is separated flows into the inlet tank 210. Centrifugal force becomes weak due to difference of cross-sectional areas between the inlet tank 210 and the inflow port 241, and rotation of the coolant is stopped. After that, the coolant flows from the inlet tank 210 to the heat-exchanging portion 230 and passes through the heat-exchanging portion 230. At this time, the coolant is cooled through heat-exchange with the air.

Meanwhile, since the bubble separated from the coolant is lighter than the coolant, the bubble moves to the extended portion 245 formed at an upper portion of the bubble generating portion 143. After that, the bubble is exhausted to the reserve tank 205 through the bubble exhaust port 247 formed at an upper portion of the extended portion 245.

Since the internal pressure of the reserve tank 205 is the same as that of the engine 203, pressure of the bubble separated from the coolant is higher than the internal pressure of the reserve tank 205.

Therefore, the bubble separated in the inflow port 241 is exhausted to a space formed at an upper portion of the reserve tank 205 through the bubble exhaust port 247 continuously.

In addition, the coolant supplement port 249 is disposed apart from the bubble exhaust port 247 and is formed at a side of a lower portion of the extended portion 245. The coolant supplement port 249 is connected to a lower portion of the reserve tank 205 so as to supplement the coolant in the inlet tank 210.

If there is lack of the coolant in the inlet tank 210, the coolant discharged from the reserve tank 205 is flowed into the inlet tank 210 through the coolant supplement port 249 so as to supplement the coolant to the inlet tank 210.

Hereinafter, operation of the radiator 200 for the vehicle according to various embodiments of the present invention will be described in detail.

Figure 6:
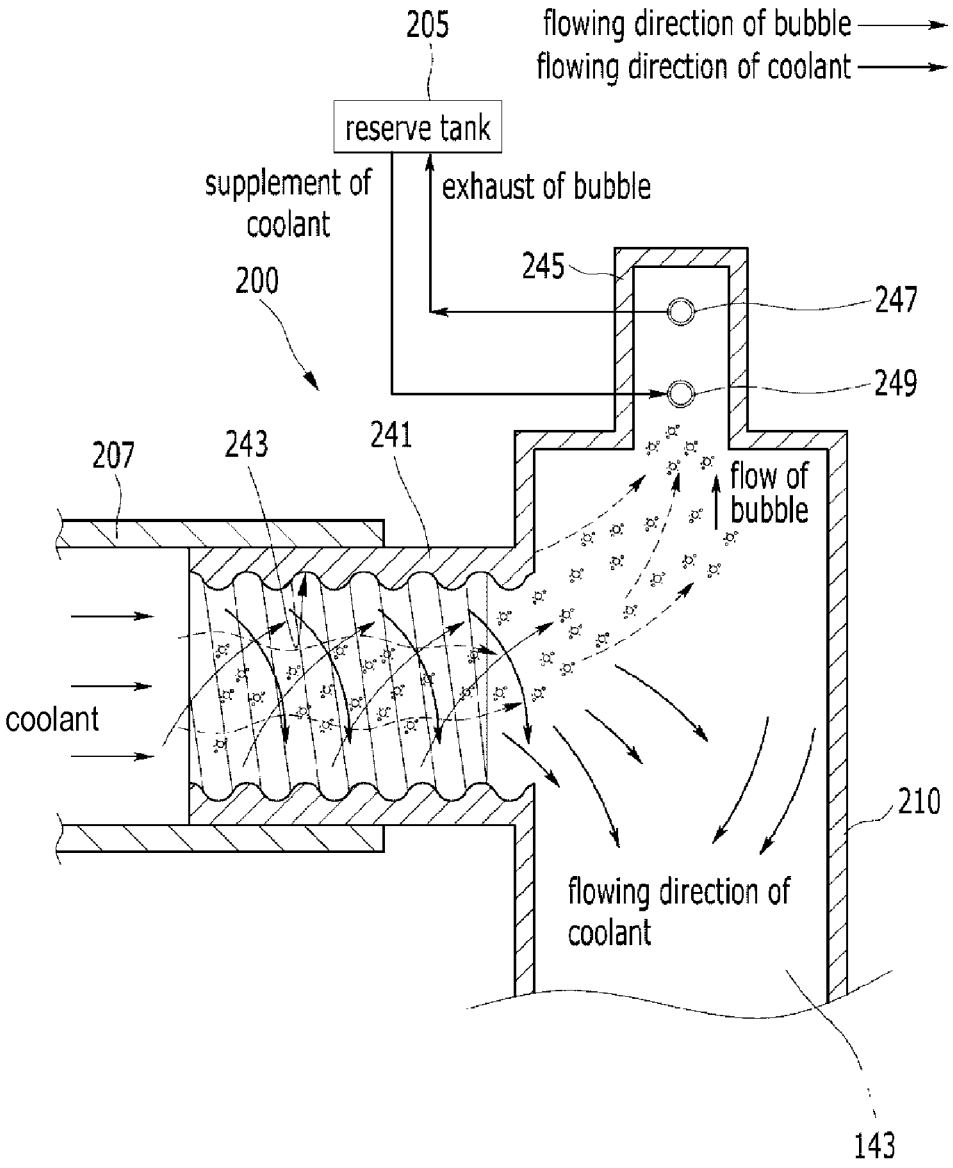
FIG. 6 is a cross-sectional view for showing operation of an exemplary radiator for a vehicle according to the present invention.

FIG. 6 is a cross-sectional view for showing operation of a radiator for a vehicle according to various embodiments of the present invention.

Referring to the drawing, the coolant cooling the engine 203 flows into the inflow port 241 of the inlet tank 210 through the connecting hose 207.

The coolant is rotated by the bubble generating portion 243 of spiral groove shape formed at the inflow port 241 and flows into the inlet tank 210.

When the coolant is rotated along the interior circumference of the bubble generating portion 243, the whirlpool is generated at the center potion of the bubble generating portion 243 in the length direction by centrifugal force. At this time, the bubble moves to the center of the whirlpool and is separated from the coolant.

If the coolant passes through the inflow port 241 and flows into the inlet tank 210, centrifugal force becomes weak and rotation of the coolant is stopped.

At this time, since the bubble separated from the coolant is lighter than the coolant, the bubble moves to the extended portion 245 formed at an upper portion of the inlet tank 210 and is exhausted to the reserve tank 205 through the bubble exhaust port 247.

At this time, since the pressure of the bubble moving in the extended portion 245 is higher than the internal pressure of the reserve tank 205, the separated bubble can be discharged to the reserve tank 205 continuously.

In addition the coolant flowing into the inlet tank 210 passes through the heat-exchanging portion 230 and is cooled through heat-exchange with the air. After that, the coolant is supplied again to the engine through an outlet 221 formed at the outlet tank 220. Therefore, the coolant cools the engine 203.

Figure 7:
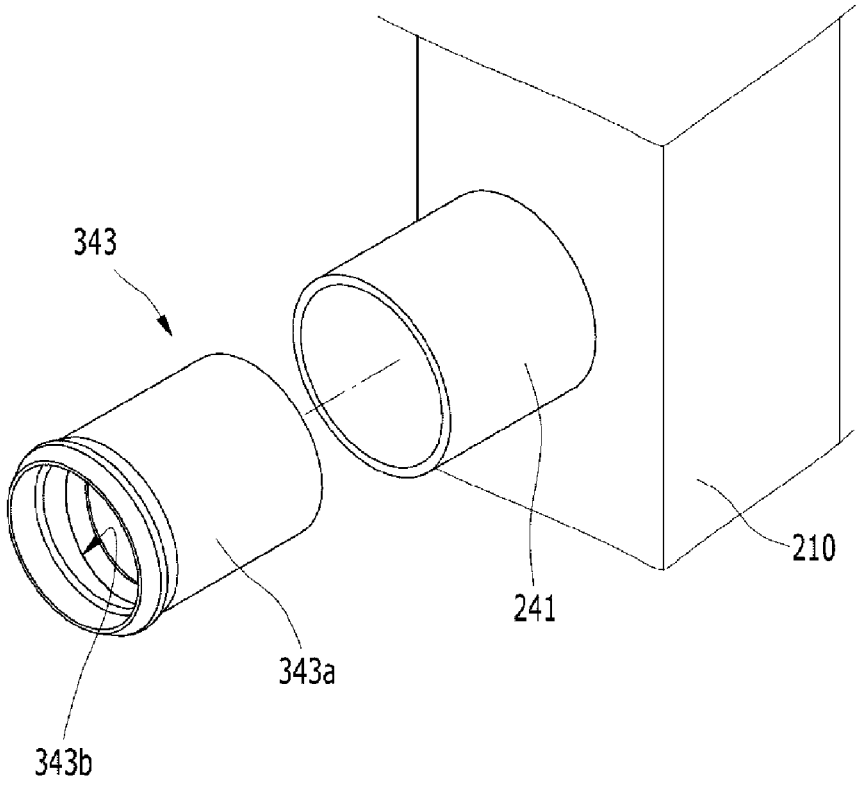
FIG. 7 is a perspective view of an exemplary bubble generating portion applied to a radiator for a vehicle according to the present invention.

FIG. 7 is a perspective view of a bubble generating portion applied to a radiator for a vehicle according to various embodiments of the present invention.

The radiator 200 according to various embodiments of the present invention is the same as those described above except a structure of the bubble generating portion 343.

The bubble generating portion 343 according to various embodiments of the present invention, as shown in FIG. 7, includes an inserting body 343*a* and a spiral groove 343*b*.

The inserting body 343*a* is inserted in the inflow port 241 and is fixed to the interior circumference of the inflow port 241.

The inserting body 343*a* is formed with a pipe of a cylindrical shape having a predetermined thickness.

In addition, the spiral groove 343*b* has the spiral shape and is integrally and/or monolithically formed at an interior circumference of the inserting body 343*a* in a length direction.

That is, the bubble generating portion 343 according to various embodiments of the present invention, different from various embodiments, is separately formed from the inflow port 241. The bubble generating portion 343 is inserted in and fixed to the inflow port 241 of the inlet tank 210. Operation of the bubble generating portion 343 according to various embodiments of the present invention is the same as that of the bubble generating portion 243. Therefore, detailed description will be omitted.

The radiator 200 for the vehicle according to various embodiments of the present invention is adapted to prevent increase of flow resistance of coolant passing through a heat-exchanging portion 230 by bubble contained in the coolant and to improve cooling efficiency by separating the bubble from the coolant supplied from an engine 203 and by supplying the bubble to a reserve tank 205 continuously.

In addition, the radiator 200 for the vehicle according to various embodiments of the present invention is adapted to improve cooling performance of the engine 203 without increasing capacity of the radiator 200, to reduce a size of the radiator 200, to lower manufacturing cost, and to improve utilization of space in an engine compartment by improving cooling efficiency of the coolant and cooling the coolant to a demand temperature.

In addition, since the coolant from which the bubble is separated is flowed into the radiator 200 according to various embodiments, air inflow in the radiator 200 may be reduced and coefficient of heat transfer may be lowered.

When explaining the radiator 100 and 200 for the vehicle according to various embodiments of the present invention, it is exemplified that the bubble generating portion 143, 243, and 343 of the bubble separating unit 140 and 240 is formed at the inflow port 142 and 241. The bubble generating portion 143, 243, and 343, however, cannot be formed at the inflow port 142 and 241. The bubble generating portion formed with the spiral groove may be formed at an interior circumference of an end portion of the connecting hose 107 and 207 connected to the inflow port.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A radiator for a vehicle comprising:

an inlet tank adapted to receive coolant from an engine;

an outlet tank disposed apart from the inlet tank and adapted to discharge the coolant back to the engine;

a heat-exchanging portion fluidly connecting the inlet tank and the outlet tank and provided with a plurality of tubes and radiation fins to cool the coolant flowing in the tubes by exchanging heat with air; and a bubble separating unit connected to the inlet tank and adapted to separate bubble contained in the coolant discharged from the engine and to continuously discharge the coolant from which the bubble is separated to the inlet tank to supply the coolant from which the bubble is separated to the heat-exchanging portion, wherein the bubble separating unit comprises:

a main body provided with an inflow port formed at a side surface thereof and connected to the engine through a connecting hose and a first exhaust port formed at another side surface thereof and connected to an inlet formed at the inlet tank;

a bubble separating portion formed at an interior circumference of the inflow port and adapted to cause the coolant to rotate and generate a whirlpool to separate the bubble from the coolant when the coolant flows into the inflow port; and a second exhaust port formed at a side surface of an upper portion of the main body and connected to the reserve tank to exhaust the bubble separated from the coolant at the bubble separating portion to the reserve tank.

2. The radiator of claim 1, wherein the bubble separating portion is a spiral groove formed at an interior circumference of the inflow port with a spiral shape.

3. The radiator of claim 1, wherein a mounting position of the inflow port is higher than that of the first exhaust port.

4. The radiator of claim 1, wherein the first exhaust port is formed at another side surface neighboring the side surface where the inflow port is formed.

5. The radiator of claim 1, further comprising a coolant supplement port integrally formed at an upper portion of the inlet tank, wherein the coolant is supplemented from the reserve tank through the coolant supplement port.

6. A radiator for a vehicle comprising:

an inlet tank adapted to receive coolant from an engine;

an outlet tank disposed apart from the inlet tank and adapted to discharge the coolant back to the engine;

a heat-exchanging portion fluidly connecting the inlet tank and the outlet tank and provided with a plurality of tubes and radiation fins to cool the coolant flowing in the tubes by exchanging heat with air; and a bubble separating unit connected to the inlet tank and adapted to separate bubble contained in the coolant discharged from the engine and to continuously discharge the coolant from which the bubble is separated to the inlet tank to supply the coolant from which the bubble is separated to the heat-exchanging portion, wherein the bubble separating unit comprises:

an inflow port integrally formed at a side of an upper portion of the inlet tank and connected to the engine through a connecting hose to receive the coolant from the engine;

a bubble separating portion formed at the inflow port and adapted to cause the coolant to rotate and generate a whirlpool to separate the bubble from the coolant when the coolant flows into the inflow port;

an extended portion protruded from an upper end of the inlet tank, wherein the extended portion is vertically spaced away from a longitudinal axis center axis in an inflow port of the bubble separating portion rotating coolant, so as to collect bubbles floating upwards; and a bubble exhaust port formed at a side of an upper portion of the extended portion and connected to the reserve tank to exhaust the bubble separated from the coolant at the bubble generating separating portion to the reserve tank.

7. The radiator of claim 6, wherein the bubble separating portion is a spiral groove formed at an interior circumference of the inflow port with a spiral shape.

8. The radiator of claim 6, wherein the bubble separating portion comprises:

an inserting body inserted in the inflow port and fixed to an interior circumference of the inflow port; and a spiral groove formed at an interior circumference of the inserting body along a length direction.

9. The radiator of claim 1, wherein the reserve tank is connected to the engine.

10. The radiator of claim 9, wherein an internal pressure of the reserve tank is maintained to be the same as that of the engine.

11. The radiator of claim 6, further comprising a coolant supplement port disposed apart from the bubble exhaust port, formed at a side of a lower portion of the extended portion, and connected to the reserve tank to supplement the coolant.

* * * * *